US007901290B2

(12) United States Patent
Temple

(10) Patent No.: US 7,901,290 B2
(45) Date of Patent: Mar. 8, 2011

(54) TABLE GAME

(76) Inventor: Robert Temple, Napier (NZ)

( * ) Notice: Subject to any disclaimer, the term of this patent is extended or adjusted under 35 U.S.C. 154(b) by 1067 days.

(21) Appl. No.: 11/573,239

(22) PCT Filed: Aug. 16, 2004

(86) PCT No.: PCT/NZ2004/000186
§ 371 (c)(1),
(2), (4) Date: Feb. 5, 2007

(87) PCT Pub. No.: WO2006/019312
PCT Pub. Date: Feb. 23, 2006

(65) Prior Publication Data
US 2008/0051196 A1 Feb. 28, 2008

(51) Int. Cl.
*A63F 9/24* (2006.01)
*A63F 13/00* (2006.01)
*G06F 17/00* (2006.01)
*G06F 19/00* (2006.01)

(52) U.S. Cl. ..... 463/36; 273/108.1; 273/108.51; 273/317.3; 273/85; 273/108.56; 273/110

(58) Field of Classification Search ..... 463/2, 36; 273/108.5, 108.51, 108.52, 108.53, 108.54, 273/108.55, 108.56, 108.57
See application file for complete search history.

(56) References Cited

U.S. PATENT DOCUMENTS

| | | | | |
|---|---|---|---|---|
| 2,939,709 | A * | 6/1960 | Verveer | 273/118 A |
| 3,931,972 | A * | 1/1976 | Fabian | 273/110 |
| 4,012,040 | A * | 3/1977 | Fernandes | 273/108.56 |
| 4,691,920 | A | 9/1987 | Murhpy et al. | |
| 4,691,921 | A * | 9/1987 | Iseki | 273/108.51 |
| 5,046,734 | A * | 9/1991 | Laine | 273/108.51 |
| 6,189,885 | B1 * | 2/2001 | Hamot | 273/108.1 |
| 6,663,108 | B2 * | 12/2003 | Makhoul | 273/317.3 |

FOREIGN PATENT DOCUMENTS

| | | |
|---|---|---|
| FR | 2748216 A1 | 11/1997 |
| GB | 2182574 A | 5/1987 |

* cited by examiner

*Primary Examiner* — Paul A. D'Agostino
(74) *Attorney, Agent, or Firm* — David A. Guerra

(57) ABSTRACT

A table game includes a lower level (2) providing a surface on which a plurality of player pieces (21) can move, an upper level (1) providing a surface on which a game is played and including a plurality of slots, a plurality of player pieces extending from the lower level and through the slots in the upper level, a plurality of electronic movement devices coupled to the player pieces to provide movement to the player pieces, and control means (4) for controlling the electronic movement of the player pieces.

20 Claims, 2 Drawing Sheets

TABLE GAME

FIELD OF INVENTION

The invention relates to table games and in particular to table ball games with teams of players.

BACKGROUND

Foosball is a table soccer game. Each game of foosball involves two players, each player in control of one of the two teams. The teams comprise a number of player pieces attached to one of four rods and handles. Each rod has a number of player pieces ranging from two to four positioned along the length of the rod. The rods extend through the sides of the table and through the player pieces at the same height and can be rotated by a handle on one end. The handle allows the player to rotate the rods and player pieces. The rods can also be moved horizontally to move the location of the player pieces. Horizontal movement of the rods is restricted by bungs on the rods so that the rods cannot be pulled out of the table. The handles for the first player are along one side of the table and the handles for the second player are along the other side of the table. The foosball table includes markings for a soccer game with a goal at each end and a centre line. The player pieces for each team face the opposing team's goal. To play a game one team starts with an opening kickoff. The objective is to pass a ball between the player pieces on one team and move the ball into the opponent's goal.

Foosball is a purely manual game that requires each player to operate a number of handles to move and rotate their player pieces to push the ball around the table. The players stand on opposite sides of the table with the goals at each end of the table.

SUMMARY OF INVENTION

It is the object of the present invention to provide an alternative table game or to at least provide the public with a useful choice.

In broad terms in one aspect the invention comprises a table game including a lower level providing a surface on which a plurality of player pieces can move, an upper level providing a surface on which a game is played and including a plurality of slots, a plurality of player pieces extending from the lower level and through the slots in the upper level, a plurality of electronic movement devices coupled to the player pieces to provide movement to the player pieces, and control means for controlling the electronic movement devices and thereby the movement of the player pieces.

Preferably the lower level includes defined areas along which each player piece can move. These defined areas may be guide tracks for conveyor belt systems or any suitable system.

Preferably the defined areas on the lower level are substantially aligned with the slots in the upper surface.

Preferably each player piece has a separate controller.

Preferably the controllers control the movement of each player piece along the defined area provided by the lower level and also rotational movement of the player pieces.

Preferably the table game includes sides that extend upwards from at least the upper surface.

Preferably the table game includes ends that extend upwards from at least the upper surface.

Preferably the table game includes scoring areas, one at each end of the upper surface.

Preferably the player pieces are arranged in two teams.

Preferably the player pieces include means to move within the defined areas on the lower level, a central axis extending through the player piece, the player piece extending through a slot in the upper level and including at least one substantially horizontal extension above the upper level.

Preferably the upper level includes game markings.

In broad terms in another aspect the invention comprise a player piece including a base portion adapted to move, a substantially vertical axis extending from the base portion, at least one substantially horizontal extension spaced from the base portion and able to rotate about the substantially vertical axis.

Preferably the player piece is adapted to move along a defined area.

Preferably the player piece includes a second substantially horizontal extension in the same horizontal plane as the first substantially horizontal extension.

Preferably the player piece includes a body piece that extends upwards from the horizontal extension(s).

Preferably the body piece includes indication markings that may include a team indication and a player number indication.

In broad terms in another aspect the invention comprises a table including a lower level providing a surface on which a plurality of player pieces can move, and an upper level providing a surface on which a game in played and including a plurality of slots.

BRIEF DESCRIPTION OF DRAWINGS

The invention will be further described by way of example only and without intending to be limiting with reference to the following drawings, wherein.

DETAILED DESCRIPTION

Figure 1:
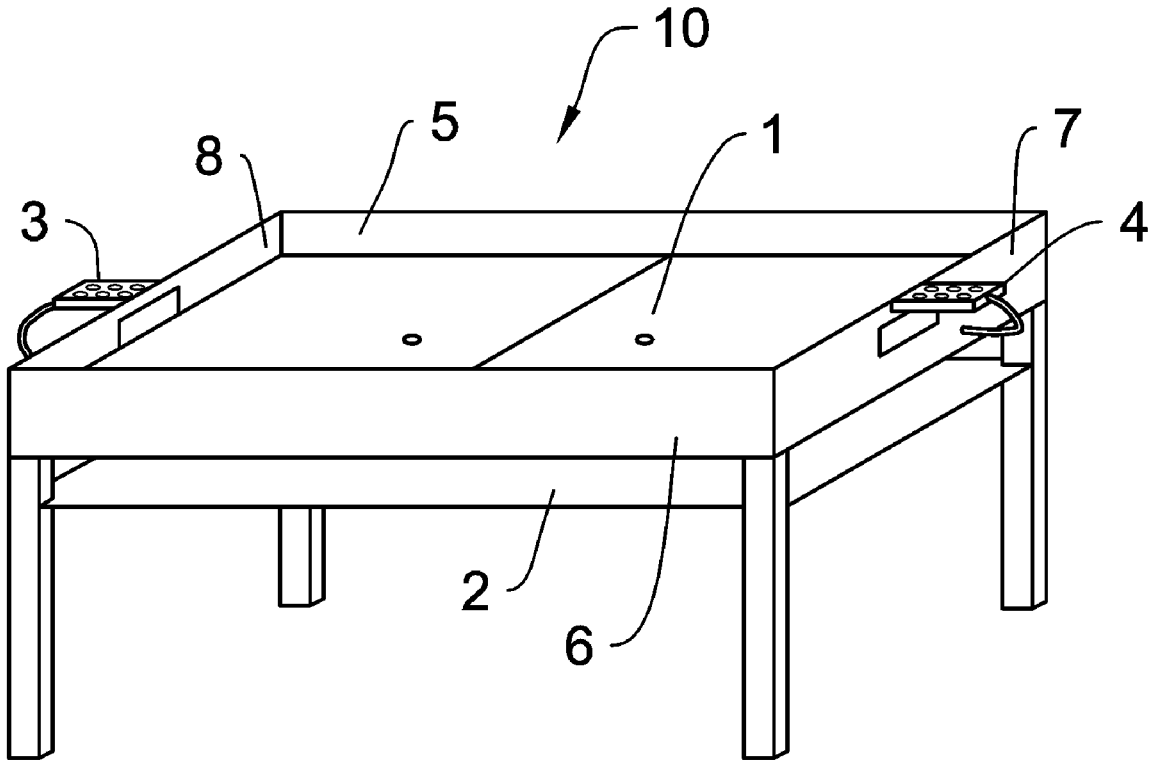
FIG. 1 is perspective view of one embodiment of table game of the invention.

FIG. 1 shows one embodiment of table game of the invention. The table game 10 includes upper level 1, lower level 2, consoles 3 and 4, sides 5 and 6, and ends 7 and 8. The table game of FIG. 1 does not show any player pieces although these will be present when any game is played.

Player pieces (shown in FIGS. 2 and 4) include portions moveable on the upper level where a game is played. Lower level 2 provides a level where the player pieces move along defined paths. Consoles 3 and 4 control the movement of the player pieces. Consoles 3 and 4 include at least one controller for each player piece controlled by the console. FIG. 1 shows the consoles with a wired connection. In some embodiments the consoles may control player pieces through wireless connections.

In preferred embodiments the table game is provided with sides 5 and 6, and ends 7 and 8. These sides and ends provide rebound surfaces for a ball when the table game is being played. The sides and ends may extend to lower level 2 so that none of the equipment on lower level 2 can be viewed. In this embodiment some access (for example a removable side or end) may be provided to lower level 2.

As shown in FIG. 1 the table game may include legs so that the table game is free standing. In other embodiments the table game does not include legs and may sit on an existing table, floor or other surface.

As shown in FIG. 1 the table game 10 may include markings on the upper level 1. These markings may include a centre line (shown in FIG. 1) penalty spots (shown in FIG. 1), special instruction areas where the instructions are followed in the ball stops in that area (not shown in FIG. 1) and goal areas where a point is scored if the ball enters the goal area (not shown in FIG. 1).

An alternative to goal areas marked on the upper level are goal areas marked on the ends (as shown in FIG. 1) or goal areas that extend outside of the ends (not shown). Goal areas that extend outside of the ends may include an extension of the upper level and a net which can be either solid or mesh. Any other suitable goal area indication may be used instead. The goals may include an electronic goal scorer that records each goal as it happens. The goal may also include a recorded voice that shouts "goal" when a goal is scored.

Upper level 1 includes a plurality of slots (one for each player piece) that are aligned with the defined areas of the lower level. The player pieces extend through the slots in the upper level.

Upper level 1 may include sloped areas. In embodiments where upper level 1 includes sloped areas it is preferred that these areas are at the edges and corners of the upper level. These areas should slope towards the centre of the table so that if a ball rolls into these areas it will roll back into the area of play.

In alternative embodiments where upper level 1 has no sloped areas that ball may be moved to a penalty area if it stops outside the reach of any player piece.

In some embodiments the table game may include a transparent top. The top sits over the upper level one the top of the sides and ends without obstructing access to the consoles. An advantage of proving a table game with a top is that in use no equipment (for example a ball) can escape from the game.

When the table game is used in a commercial setting the table game may be coin operated with the appropriate coins buying a period of power to the consoles.

The table game may be mains powered or battery powered.

Although the table game in FIG. 1 is rectangular the shape of the table game may differ depending on the number of teams. For example the table game could be square and have four teams. In another embodiment the table game could be hexagonal and have six teams. Each team has a goal to defend. In an embodiment with more than two teams different numbers of points may be scored depending on the location of the goal relative to the team.

In one embodiment the table game is rectangular and approximately 140 cm in length and 60 cm in width. The table has sides and ends of approximately 10 cm in height and cushions to allow the ball to rebound during play. Goals are formed at the ends of the table, situated centrally approximately 7 cm high and 20 cm long. Goals allow players to score by passing the ball through the opening of the goal.

The upper level of the table is flat with some gentle contours. The upper level is constructed with wood and plastic. The table includes removable legs.

Player pieces are formed of plastic, wood and metal and extend from the lower level of the table through the upper level. Each player piece includes a magnetic band on a horizontal extension that holds the ball until the player piece is moved to release the ball or pass the ball to another player piece. The game is played on the upper level. The lower level houses electrical and mechanical equipment for player piece movement.

In this embodiment there are six player pieces on each of two sides. Each team of player pieces is a different colour for easy identification when passing the ball between player pieces. Consoles that control player piece movement are at the ends of the table. The consoles include one button per player piece on the relevant team that allows movement by pressing the button and rotation of the player piece by rotating the button or moving a switch.

The number of player pieces on the board can vary and is typically between eight and twenty-two. The size of the board and size of the player pieces may also vary from a small handheld version to large table sized versions of the game.

The ball used for the game can be of any suitable material. For example the ball may be metal, cork or plastics. In the embodiment described above the ball is 20 cm in diameter.

Figure 2:
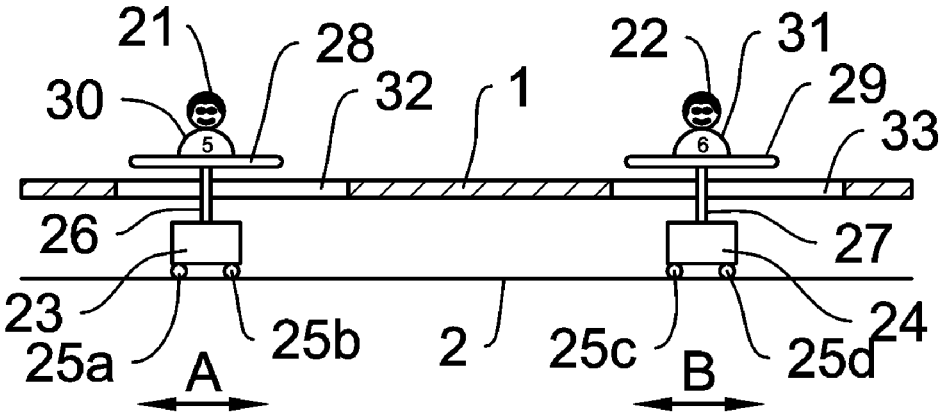
FIG. 2 is a perspective view of a player piece of the invention.

FIG. 2 shows two player pieces 21 and 22. Each player piece include a bottom portion 23, 24, a substantially vertical axis 26 and 27, and at least one substantially horizontal extension 28, 29 from the axis 26 and 27 respectively.

Player pieces include movement means (not shown) that provide movement power to the pieces. The movement means may be provided in the bottom portions of the player pieces. The movement means are preferably electric motors that provide motion to the player piece and also allow the player piece to rotate about its vertical axis. The movement means may include more than one motor for each player piece. For example stepper motors with power between 3 and 12 volts may be provided. These motors take several movements to complete a 360 degree turn of a player piece about axis 26 or 27.

In the table game of the invention the player pieces are constrained to move along defined paths on the lower level 2 and within slots 32, 33 in the upper level 1. Motors are provided to give motion in these directions. The motors may provide power directly to wheels 25*a* to 25*d* or some other means of moving the player pieces may be provided. For example the player pieces may be arranged on conveyors that are controlled by motors. Controls for the movement means are provided on consoles (shown in FIG. 1).

The movement means allow the player pieces to move along defined paths on the lower level, indicated by arrows A and B and also to rotate about a substantially vertical axis, axis 26 on player piece 21 and axis 27 on player piece 22. Movement of the player pieces is controlled by a console.

The player pieces each include at least one substantially horizontal extension from the substantially vertical axis. In FIG. 2 the horizontal extensions are arm 28 extending from vertical axis 26 of player piece 21 and arm 29 extending from vertical axis 27 of player piece 22. In the embodiment shown in FIG. 2 the substantially horizontal extensions extend in two directions from the axis. In alternative embodiments the substantially horizontal extensions may extend in only one direction from the axis. In further alternative embodiments more that two substantially horizontal extensions may be provided on a player piece. For example a player piece may be provided with four substantially horizontal extensions with an angle of 90 degrees between the extensions.

Figure 4:
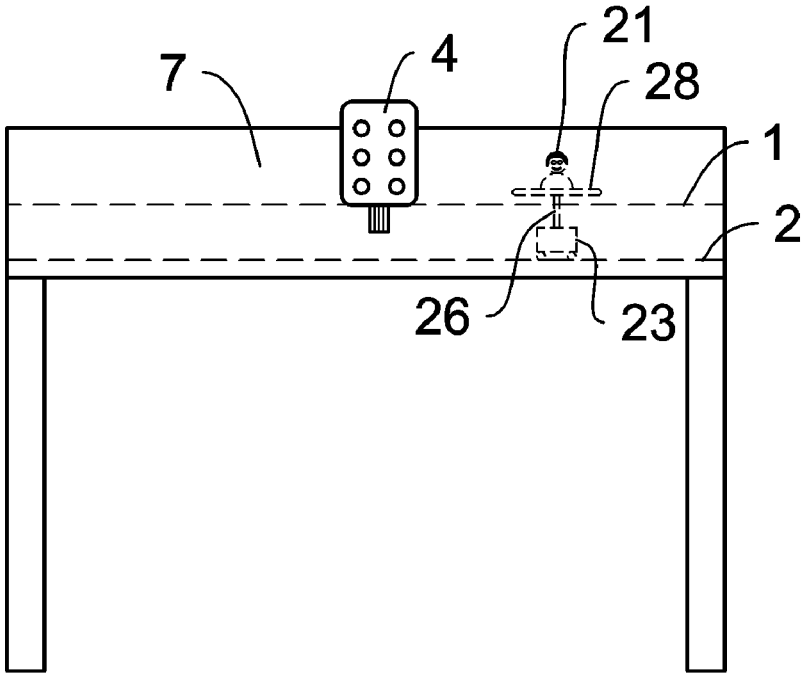
FIG. 4 is a cut-away end view of one embodiment of table game of the invention.

The substantially horizontal extensions are at a height above the bottom portion of the player piece so that in use the extensions will be above the upper level at a height to intercept a ball when a game is played on the game table (as shown in FIG. 4). For example if the top of the upper level 1 is 150 mm above the top of the lower level 2 and the ball for the table game has a diameter of 10 mm the horizontal extensions may be 155 mm above the bottom of the player pieces.

The horizontal extensions may be provided with magnetic strips along the extensions to attract balls in the table game. For example if the ball is metal it will be attracted to the magnetic strips on the horizontal extensions of the player pieces as it nears the player pieces. This will make it easier for the player pieces to attract the ball but more force may be necessary for the player pieces to release the ball than if magnetic strips weren't provided. The horizontal extensions may also be flexible enough to bend into a 'V' position to make better use of the magnetic strip.

As shown in FIG. 2 the player pieces may include an upper body portion above the horizontal extensions. The upper body portion may be provided for aesthetic reasons to make the upper part of the player piece resemble part of a person. The upper body portion may include a head and an upper body portion as shown in FIG. 2. The upper body portion may be designed as a soccer football jersey with appropriate markings. Alternatively any suitable design and marking may be provided. The player pieces may even be designed to be male and female. Each team of player pieces may be different colour for the other team. For example one team may have red jerseys on the upper body portion and the other team may have blue jerseys on the upper body portion.

The player pieces include an indication that allows the pieces to be matched to controls on the console. This indication may be a number on each player piece. For example in FIG. 2 the player pieces include numbers on the upper body portions.

Figure 3:
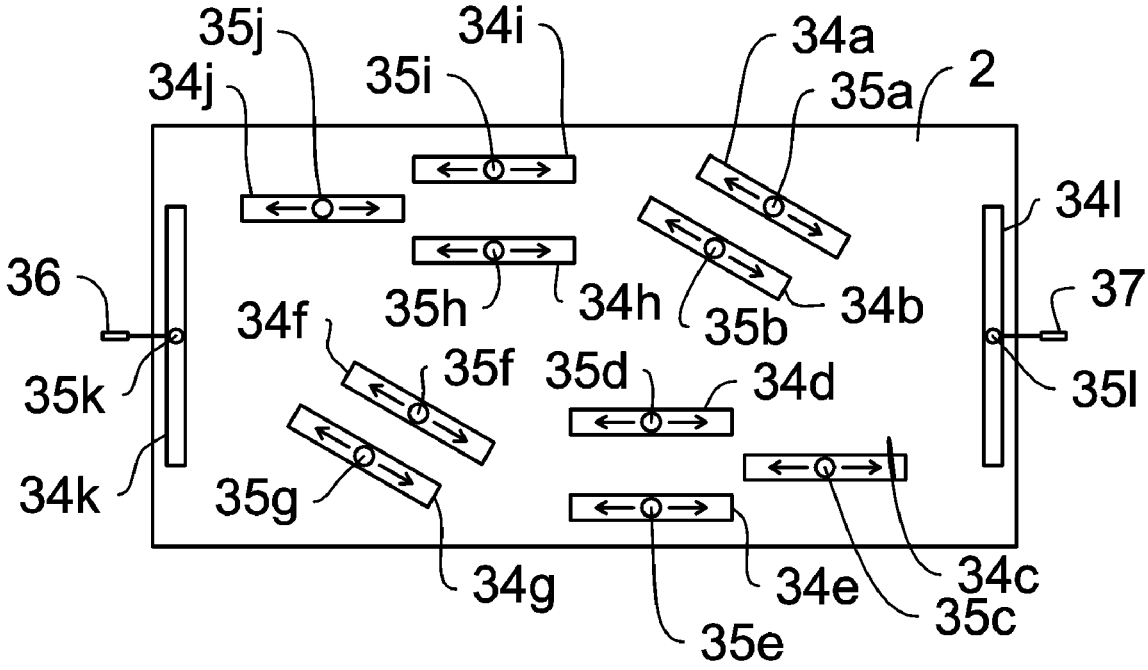
FIG. 3 is a top view of a lower level that form part of the table game of the invention.

FIG. 3 is a top view of the lower level 2 of the table game. The lower level 2 includes a plurality of defined areas 34*a*-34*l*. Each defined area provides the allowed movement of a player piece 35*a*-35*l*. The defined areas may be tracks or conveyor belts or any other suitable means for restricting the movement of the player piece to the defined area. As can be seen by the arrows in FIG. 3 player pieces 35*a*-35*l* can only move along the paths of defined areas 34*a*-34*l*. It should be noted that the defined areas and number of players here are shown as an example only and the position, number and size of the defined areas and number of players may differ without affecting the scope of the invention.

Player pieces 35*k* and 35*l* in FIG. 3 have to role of goal keepers defending the goal of each team. In FIG. 3 these player pieces have longer guides than the other player pieces. Player pieces 35*k* and 35*l* also have handles 36 and 37 that extend from the table game. These handles allow the player pieces to be moved manually.

It should be noted that while FIG. 3 shows lower level 2 of the table game as being a solid plane this is not essential. Lower level 2 must provide defined areas along which the player pieces can move but need not be a solid plane.

FIG. 4 is an end view of one embodiment of table game of the invention. FIG. 4 shows one embodiment of console for the table game. The consoles may be positioned at each end of the table game. The consoles may be fixed in place or may be moveable allowing a player to move the console to a preferred playing position.

In FIG. 4 console 4 is shown with a wired connection to the movement means for the player pieces. In alternative embodiment the movement means may be controlled by the console by wireless communication.

The orientation of the player pieces can be seen in FIG. 4 shown by player piece 21. FIG. 4 shows that the bottom portion of the player piece is on lower level 2 while the upper portion of the player piece extends above upper level 1. The horizontal extensions of the player piece are above upper level 1. This arrangement means that the movement means of the player pieces does not interfere with the game.

In use the table game player pieces are arranged in two teams, each team controlled by one console. The controllers on the console allow a user to move each player piece in their team along a guide path and to rotate each player piece. A ball is also provided as part of the table game. It is first decided which team of player pieces starts. Balls can be made of any suitable material. Once this is decided the ball is placed at a starting point (for example the penalty spot shown in FIG. 1) on upper level 1 and the user operating the starting team controls a player piece to move the ball. The player pieces can move the ball by rotating so that the horizontal extensions of the player piece hit the ball. The player piece can also control the ball during movement along the path of the player piece. The aim of the game is to move the ball into the goal area of the opposing team. Games can be played to a time limit (for example the user with the most goals at the end of five minutes wins) or to a goal limit (for example the first user to five goals wins).

The foregoing describes the invention including preferred forms thereof. Alterations and modifications as will be obvious to those skilled in the art are intended to be incorporated in the scope hereof as defined by the accompanying claims.

The invention claimed is:

1. A table game system comprising:

a metal game ball;

a lower level providing a surface on which a plurality of player pieces can move;

an upper level providing a surface on which a game is played, said upper level defining a plurality of slots;

a plurality of player pieces extending from said lower level and through said slots in said upper level, each of said player pieces having a substantially horizontal extension including a magnetic strip thereon that is engagable with said metal game ball;

at least one electronic movement device coupled to each of said player pieces to provide movement to said player pieces; and control means for controlling said electronic movement devices and thereby the movement of said player pieces.

2. The table game system as set forth in claim 1, wherein each of said player piece has a separate controller, each of said controllers control the movement of each said player piece along said defined area provided by said lower level and also rotational movement of said player pieces.

3. The table game system as set forth in claim 1 further comprising sides that extend upwards from at least said upper level, and ends that extend upwards from at least said upper level.

4. The table game system as set forth in claim 1, wherein said lower level includes defined areas along which each of said player piece can move, said defined areas on said lower level are substantially aligned with said slots in said upper surface.

5. The table game system as set forth in claim 3 further comprising at least two scoring areas, one at each end of said upper level.

6. The table game system as set forth in claim 5 further comprising removable legs, and a transparent top positioned over said sides and ends.

7. The table game system as set forth in claim 6, wherein said upper level having sloped areas located at the edges and corners of said upper level, said sloped areas slope towards the centre of said upper level.

8. The table game system as set forth in claim 4, wherein each of said player pieces having a base portion adapted to move in said defined areas, and a substantially vertical axis extending from said base portion and adapted to pass through said slot, said horizontal extension being spaced from said base portion and able to rotate about the substantially vertical axis.

9. The table game system as set forth in claim 8, wherein each of said player pieces having a second substantially horizontal extension in the same horizontal plane as said substantially horizontal extension.

10. The table game system as set forth in claim 8, wherein said electronic movement device is at least one motor located in said base portion of each of said player pieces, and wherein said defined areas are guide tracks for restricting movement of said player pieces to said defined areas respectively.

11. The table game system as set forth in claim 8, wherein said electronic movement device is a motor controlled conveyor located in each of said defined areas.

12. The table game system as set forth in claim 8, wherein said horizontal extension and said magnetic strip have a substantially V shape.

13. The table game system as set forth in claim 9, wherein each of said player pieces having a body piece that extends upwards from said horizontal extension.

14. The table game system as set forth in claim 10, wherein said motor in said base portion being adapted to drive wheels mounted to the underside of said base portion, said wheels being in contact with said respective track on said lower level.

15. A table game system comprising:

a metal game ball;

a lower level providing a surface on which a plurality of player pieces can move;

an upper level providing a surface on which a game is played, said upper level defining a plurality of slots, said upper level having at least two scoring areas, one at each end of said upper level;

at least two sides extending and at least two ends extending upwards from said upper level;

a plurality of player pieces extending from said lower level and through said slots in said upper level, each of said player pieces having a base portion adapted to move on said lower level, a substantially vertical axis extending from said base portion and adapted to pass through said slot, at least one substantially horizontal extension spaced from said base portion and able to rotate about the substantially vertical axis, said horizontal extension being positioned above said upper level;

a magnetic strip located on said horizontal extension of each of said player pieces, said metal game ball being engagable with said magnetic strip;

a plurality of electronic movement devices coupled to each of said player pieces to provide movement to said player pieces; and control means for controlling said electronic movement devices and thereby the movement of said player pieces.

16. The table game system as set forth in claim 15 further comprising removable legs, and a transparent top positioned over said sides and ends, and wherein said upper level having sloped areas located at the edges and corners of said upper level, said sloped areas slope towards the centre of said upper level.

17. The table game system as set forth in claim 15, wherein said lower level includes defined areas along which each of said player piece can move, said defined areas on said lower level are substantially aligned with said slots in said upper surface.

18. The table game system as set forth in claim 17, wherein said electronic movement device is at least one motor located in said base portion of each of said player pieces, and wherein said defined areas are guide tracks for restricting movement of said player pieces to said defined areas respectively.

19. The table game system as set forth in claim 18, wherein said motor in said base portion being adapted to drive wheels mounted to the underside of said base portion, said wheels being in contact with said respective track on said lower level.

20. A table game system comprising:

a metal game ball;

a lower level having a surface including defined areas on which a plurality of player pieces can move;

an upper level providing a surface on which a game is played, said upper level defining a plurality of slots aligned with said defined areas of said lower level, said upper level having at least two scoring areas, one at each end of said upper level;

at least two sides extending and at least two ends extending upwards from said upper level;

a plurality of player pieces each having a base portion, wheels adapted to move in said defined areas of said lower level, at least one motor located in said base portion for driving said wheels, a substantially vertical axis extending from said base portion and adapted to pass through said slot, at least one additional motor located in said base portion for rotating said vertical axis; at least one substantially horizontal extension extending out from said vertical axis and positioned above said upper level, said horizontal extension being rotatable about said substantially vertical axis;

a magnetic strip located on said horizontal extension of each of said player pieces, said magnetic strip and said horizontal extension having a substantially V shape, said metal game ball being engagable with said magnetic strip;

control means for controlling said motors of each of said player pieces and thereby the movement of said player pieces.

* * * * *